United States Patent [19]

Bouiller et al.

[11] Patent Number: 4,522,557

[45] Date of Patent: Jun. 11, 1985

[54] COOLING DEVICE FOR MOVABLE TURBINE BLADE COLLARS

[75] Inventors: Jean G. Bouiller, Brunoy; Jean-Claude L. Delonge, Corbeil-Essonnes, both of France

[73] Assignee: S.N.E.C.M.A., Paris, France

[21] Appl. No.: 455,732

[22] Filed: Jan. 5, 1983

[30] Foreign Application Priority Data

Jan. 7, 1982 [FR] France ..... 82 00121

[51] Int. Cl.[3] ..... F01D 11/02

[52] U.S. Cl. ..... 415/115; 415/116

[58] Field of Search ..... 415/115, 116, 117, 119, 415/139, 172 A

[56] References Cited

U.S. PATENT DOCUMENTS

| | | | |
|---|---|---|---|
| 3,034,298 | 5/1962 | White | 60/726 |
| 3,314,648 | 4/1967 | Howald | 415/115 |
| 3,652,177 | 3/1972 | Loebel | 415/116 |
| 3,975,901 | 8/1976 | Hallinger et al. | 415/115 |
| 4,157,232 | 6/1979 | Bobo et al. | 415/116 |
| 4,280,792 | 7/1981 | Hartel et al. | 415/117 |
| 4,311,431 | 1/1982 | Barbeau | 415/172 |

FOREIGN PATENT DOCUMENTS

| | | | |
|---|---|---|---|
| 1548541 | 12/1968 | France . | |
| 2216443 | 8/1974 | France . | |
| 2450344 | 9/1980 | France . | |
| 1381277 | 1/1975 | United Kingdom | 415/115 |
| 1519449 | 7/1978 | United Kingdom . | |

*Primary Examiner*—Henry C. Yuen
*Assistant Examiner*—John Kwon
*Attorney, Agent, or Firm*—Oblon, Fisher, Spivak, McClelland & Maier

[57] ABSTRACT

From an external turbine chamber (17), cooling air passages are formed through coils mounted in ball-and-socket fashion (26) in a cavity portion (21) above the stationary turbine nozzle vanes (16) from which it escapes downstream through holes (29) in the platform (15) of the stationary vanes (16) in the form of jets of air parallel to the flow of the main gas flow to create a cooling film on the leading edge (30) of the shroud (9) of the movable blades (10) of the turbine rotor in order to cool these blade shroud (9). An airtight connection between this supply chamber (17) and the main flow is ensured by a flexible seal (32) formed of elastic blades (33) in sections attached to one end of the downstream flange (14) of the turbine nozzle housing (11) and supported at the other end by the turbine ring (5).

5 Claims, 4 Drawing Figures

COOLING DEVICE FOR MOVABLE TURBINE BLADE COLLARS

BACKGROUND OF THE INVENTION

1. Field of the Invention

The present invention concerns a cooling device for the movable blade shroud of a turbojet engine turbine.

2. Description of the Prior Art

The continuous research involved in improvement of turbojet engines is aimed primarily at increasing performance while observing the many restrictions imposed by both the possibilities of industrial use and the conditions of equipment use. At the level of the turbines used in these turbojet engines, pursuit of these goals has resulted in the consideration of two conditions: firstly, increasing the operating temperatures and, secondly, reducing or preventing losses affecting the main gas circulation jet.

Various improvements related to this research have been applied and described. In particular, increasingly high temperatures have made it necessary to cool the hot turbine parts, either as a result of operational needs related to problems of expansion aimed at reducing the interaction of operations, or aimed at obtaining desirable wear of the parts in service by reducing the heat gradients and respecting the limits of heat resistance.

For example, U.S. Pat. No. 3,034,298 describes a turbine cooling system. According to FIG. 5 of this patent, the cooling air from a collector 76 is sent through, firstly, holes 168 in the turbine nozzle 65 and secondly, to the turbine ring 102 which the air flows through to be sent out radially in the main jet. An additional cooling circuit is planned for the radially internal parts.

French Pat. No. 1,548,541 concerns a procedure and device for cooling gas turbines. The system described uses the cooling of a feed wheel disc by a tube of an internal cavity from which the cooling air is sent to the area of the blade roots or a ring or rim surrounding the blade tips.

British Pat. No. 1,519,449 concerns a turbojet engine in which air for cooling the turbine is sent into chambers formed in the turbine ring. This air is sent into the main gas flow via passages through additional blading which sends this air in the direction of the flux obtained at the main guide vane. The release of this air in the jet maintains a centripetal radial component.

These previous arrangements do not provide a satisfactory solution to the problem of cooling movable blade shrouds. Therefore, the objective of the present invention is to define a cooling device for the peripheral collars of movable blades of a turbine in which, by state of the art techniques, an external chamber with an air supply provides the cooling air to stationary vanes of a distributor located above the movable blades by passing through a portion located above the blades and to a turbine ring which constitutes the stationary part opposite the turbine rotor. This device according to the invention is characterized by passages which are also located in the chamber to direct the air toward the peripheral collars of the movable blades of the turbine rotor so as to ensure the cooling of these blade collars from their leading edge on the upper side in relation to the direction of gas circulation in the main gas jet.

SUMMARY OF THE INVENTION

According to an advantageous provision of the invention, in an initial design the cooling air passages can be formed by numerous holes machined in the fixed distributor blade shroud on the lower side in a multihole distribution. In this way a "film" cooling system is formed which is notably efficient for the movable blade shroud. By this method a continuous ejection section is obtained. Moreover, the choice of the position and diameter of these holes makes it possible to obtain precise calibration of the rate of flow of the cooling air.

According to another advantageous provision of the invention, in a second design the cooling air passages run through an axial annular space formed between two parts of a flange downstream the turbine nozzle the radially internal end of which opens by numerous passages made in the end of the part the flange and an associated connecting pipe. In a manner analogous to the previous provision, "film" cooling is likewise obtained from numerous holes which has the same advantages of efficiency and precise calibration of air flow with a continuous ejection section.

These results are again improved advantageously in one or the other of the previous provisions according to the invention by the circumferential slant of the cooling holes. This characteristic allows directioning of the incoming cooling air toward the leading edge of the movable blade collars according to the optimum angle for best cooling efficiency. Furthermore, perfect control of the incidence of air injection in the main gas jet is made possible. In particular, any unfavorable disruption of the flow of this jet is prevented by thus making the cooling air jets parallel to the flow or only slightly opposed to it. In no instance is an unfavorable centripetal radial component observed.

The provision according to the invention is advantageously supplemented by the installation of associated devices which ensure airtightness between the external chamber from which the cooling air is taken and the main gas circulation jet.

These devices which ensure airtightness, in an initial advantageous design, are formed by a seal composed of elastic blades in sections, one end of which is attached to the downstream flange of the turbine nozzle and the other end of which is supported by the turbine ring. The presence of this flexible seal makes it possible to absorb dimensional variations of various origins, machining tolerances, deformations, differential heat expansion, between the distributor and the turbine ring. Moreover, in the assembly process any risk of interference between the turbine nozzle and the ring is prevented and, likewise, this solution does not affect the ease of dismantling of the turbine modules.

According to a second advantageous design of the devices for ensuring airtightness, the seal is formed of elastic clamps, one end of which is attached to a radially external part of the downstream flange of the turbine nozzle. At the other end, these clamps are welded to an annular flange which is supported by a bearing above the turbine ring and by an axial bearing of the lower part of the turbine nozzle blade platform. This solution has the same advantages as previously noted and allows frontal airtightness of the turbine ring and radial airtightness on the turbine nozzle blade platform.

An additional advantageous provision is obtained by placing between the external chamber and the portion formed above the turbine nozzle blades of the coils mounted in the ball-and-socket joint at each end for the passage of cooling air. These ball-and-socket mounted spools allow limited movement between the turbine nozzle itself and the turbine nozzle support housing due to the expansion differences, sums of tolerances, or deformations.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
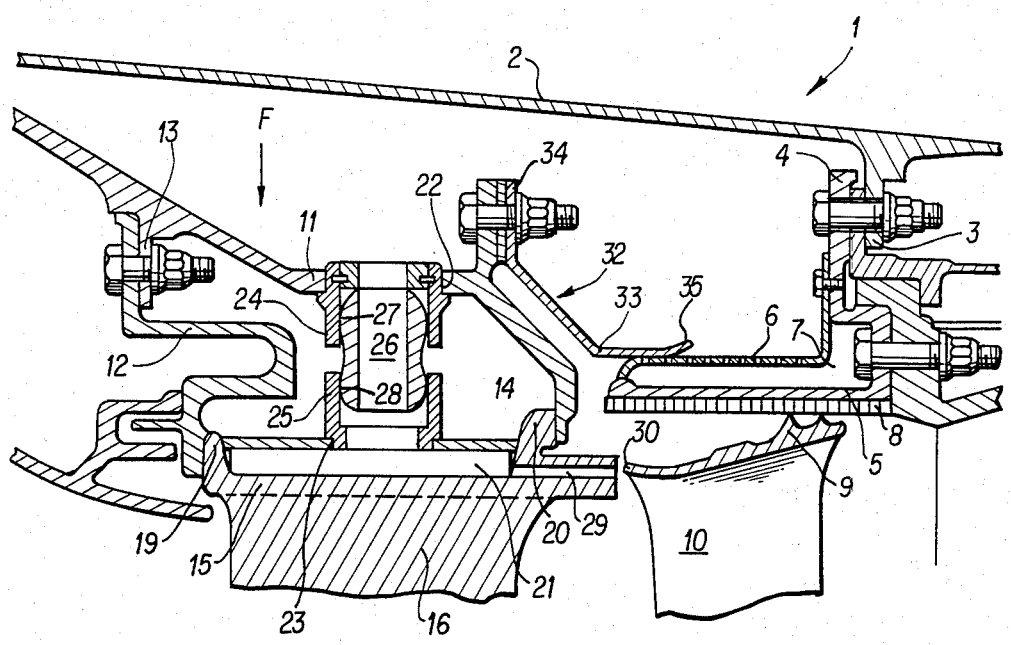
FIG. 1 is a partial axial sectional view of the turbojet engine part in which is placed the cooling device for peripheral shroud of movable turbine blades according to a first embodiment of the invention.

In FIG. 1 is shown an axial sectional view of a turbojet engine part and more specifically a high pressure turbine part 1 in an initial design of the invention. This turbine 1 is held in place by an external cover 2 having a radial flange 3 on which is bolted a support 4 which supports a turbine ring 5 delimiting the external contour of the circulation of the main gas flow. A perforated annular metal sheet 6 forms on the outside of the turbine ring 5 a cooling chamber 7.

The turbine ring 5 is fitted inside with an air-tight friction shield 8 corresponding to the shroud 9 of the movable blades 10 at an initial turbine rotor level. Inside the turbine cover 2 a housing 11 is also attached to cover 2 by a connection not shown in the drawing. An intermediate upstream support 12 connected to the flange 13 of the housing 11 and a downstream flange 14 of the housing 11 supports the turbine nozzle stage of which the platform 15 of the turbine nozzle vanes 16 are connected to it at each end. An external chamber 17 is formed between the outside turbine cover 2, on the one hand, and the turbine ring 5 and the turbine nozzle housing 11, on the other. A closing plate 18 resting on the upstream part 19 and on the downstream part 20 of the platform 15 of the turbine nozzle vanes 16 forms a cavity portion 21 above the turbine nozzle vanes 16.

The turbine nozzle housing 11, on the one hand, and the closing plate 18, on the other, have openings, 22 and 23 respectively, in which, by means of cylindrical couplings, 24 and 25 respectively, are mounted coils 26 which connect the external chamber 17 and the cavity portion 21 formed above the distributor blades 16. These spools 26 have at each end, 27 and 28 respectively thereof, a ball-and-socket form adapted to the cylindrical internal diameter of the connecting couplings, 24 and 25 respectively. In the turbine nozzle vane platforms 15, in their downstream part 20, holes 29 are machined which start in the cavity portion 21 and emerge on the right side of the leading edge 30 of the shroud 9 of the movable blades 10, this edge 30 being located on the upstream side of the shroud 9 in relation to the direction of gas circulation in the main flow. The edge 30 of the shroud 9, in relation to the extension of the shroud itself, has a slightly raised profile, the advantage of which will appear further on in the description of operation.

Figure 2:
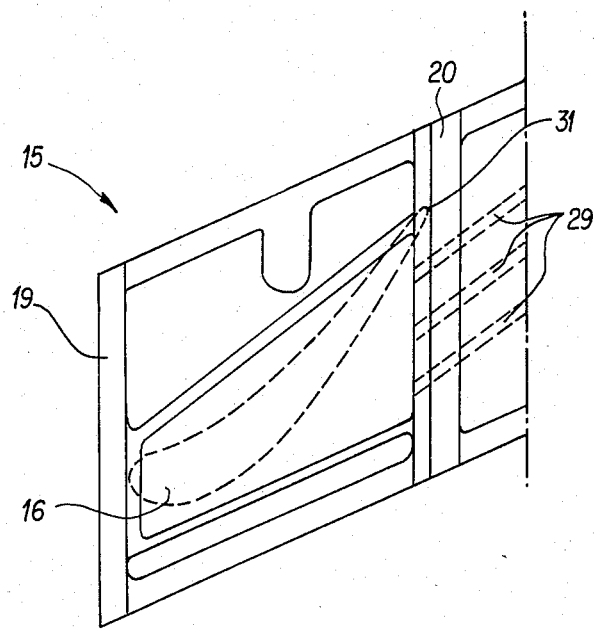
FIG. 2 is a partial view, with the housing removed, according to the direction F of the device shown in FIG. 1.

As is more easily seen in FIG. 2, the holes 29 in the platforms 15 of the turbine nozzle vanes 16 are oblique holes, slanted circumferentially on an angle which a priori is different from that of the trailing edge 31 of the turbine nozzle vanes 16 and the optimum value of which is determined based on criteria derived from operation of the device as will be described below. Between the downstream flange 14 of the turbine nozzle housing 11 and the annular sheet 6 of the turbine ring 5 is placed a seal 32. This seal 32 is formed of elastic blades 33 in sections, twelve for example. One tip 34 of the blades 33 is bolted to the upper flange 14 of the turbine nozzle housing 11 and the other tip 35 of the blades 33 is in elastic support on the annular sheet 6 of the turbine ring 5.

Figure 3:
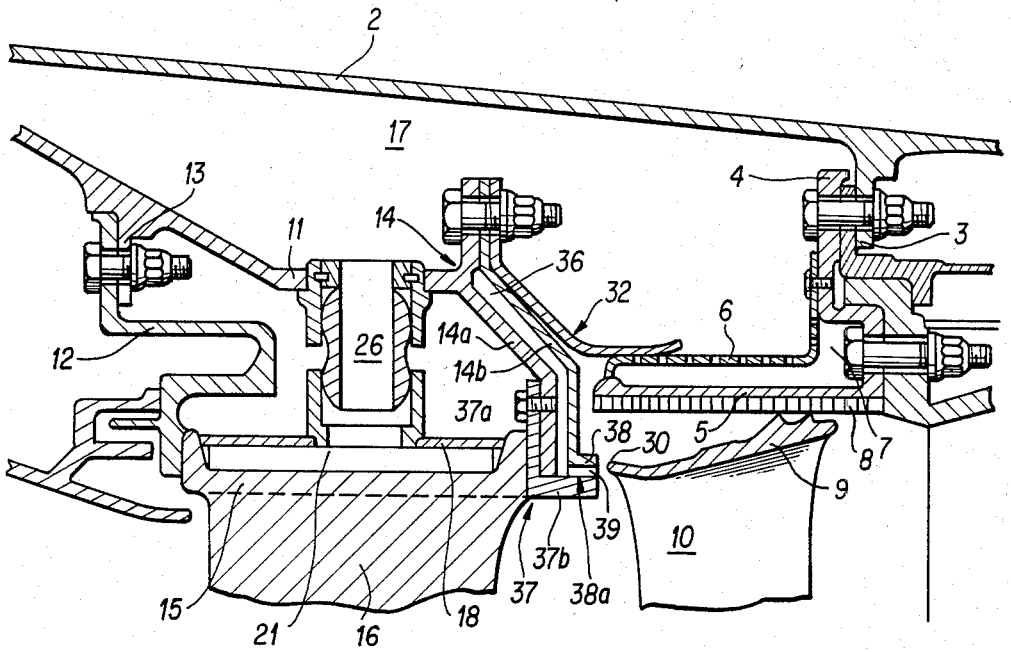
FIG. 3 is a partial axial sectional view analogous to FIG. 1 of the turbojet engine part in which is placed the cooling device for the peripheral shroud of movable turbine blades according to a second embodiment of the invention.

In FIG. 3 is represented, in a view analogous to the one in FIG. 1 and in a second embodiment of the invention, a turbojet engine part in axial section and more precisely a high pressure turbine part. The same reference numerals have been used for the same parts in the description of the two designs as well as in the figures of the corresponding drawings. According to this design, the downstream flange 14 of the turbine nozzle housing 11 is formed of two annular parts, one downstream **14*a* and the other downstream 14*b*. An annular space 36 is formed between these two parts 14*a* and 14*b*. The platforms 15 of the turbine nozzle vanes 16 and the flange 14 are connected by a angle bracket 37. The upstream flange part 14*a* is attached radially to the branch 37*a* of the angle bracket 37 and the radially internal end 38 of the downstream flange part 14*b* is supported axially on the branch 37*b* of the angle bracket 37. The radially internal face 38*a* of the end 38 of the lower flange part 14*b* supported on the branch 37*b* of the angle bracket 37 is composed of a series of longitudinal passages 39 beginning at the radially internal end of the annular space 36 and opening on the right side of the leading edge 30 of the shroud 9 of the movable blades 10. As in the first design and for the same purpose, these passages 39** have a circumferential slant.

Figure 4:
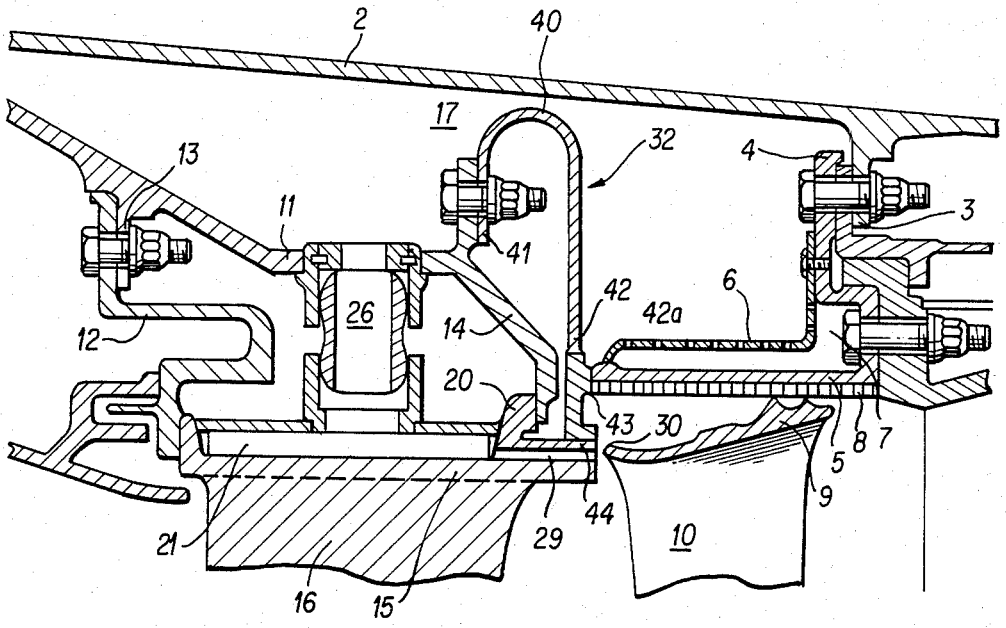
FIG. 4 is a partial axial sectional view of a second embodiment according to the present invention of devices for ensuring airtightness associated with the embodiment shown in FIG. 1.

In FIG. 4 is shown a variation according to the invention for the seal 32 placed between the turbine ring 5 and the flange 14 of the turbine nozzle housing 11. This seal 32 is formed of a plurality of elastic clamps 40 in the form of a cross, twelve for example. One end 41 of the clamps 40 is bolted to the downstream flange 14 of the turbine nozzle housing. The other end 42 is welded to an annular flange **42*a* which is, on the one hand, supported frontally on an upstream radial bearing 43 of the turbine 5 and, on the other, supported radially on an axial bearing 44 of the lower part 20 of the platform 15 of the turbine nozzle vanes 16**.

The cooling of the movable blade shroud obtained by the device according to the invention just described works together with an overall solution to the problem of cooling the hot parts of a turbine combined with obtaining minimum interaction between stationary parts and movable parts, taking into consideration the repercussions of expansion, particularly heat expansion. With this in mind, the external turbine chamber 17 receives a cooling air supply by every known means and according to every procedure adapted to the particular configuration and operating conditions of the turboshaft engine in question. These means have not been shown in the drawings and, like the procedure, will not be described in further detail.

According to the initial design of the invention, from the chamber 17 the cooling air through the numerous perforations in the annular sheet 6 cools the turbine ring 5 by jets of air, with the jets of air leaving the cooling chamber 7. The cooling air, from the chamber 17 and by means of the ball-and-socket mounted spools 26, also supplies the cavity portion 21 above the turbine nozzle vanes 16. A portion of the air from this cavity portion 21 cools the turbine nozzle vanes 16 in which the air circulates in appropriate channels. Another portion of the air leaves the cavity portion 21 through the holes 29 in the downstream part 20 of the platform 15 of the turbine nozzle vanes 16. Thus, the incoming air passing through the multihole system formed in this way creates a film on the leading edge 30 of the shroud 9 of the movable turbine blades 10. Calibration of the holes 29 allows precise control of the rate of cooling air flowing to the shroud 9 of the movable blades 10 and the optimum value given to the angle of circumferential inclination of these holes 29 allows better cooling efficiency for the blade shroud. This value is also selected in such a way as to prevent any disturbance created by the blasts of air in the flow. The raised profile given to the leading edge 30 of the blade shroud 9 contributes to the cooling efficiency obtained.

A continuous ejection section of the cooling air is likewise obtained by this method according to the invention. Note that the cooling of the blade shroud obtained has an especially advantageous application for high performance equipment such as some turbojets, in which the rotor blades used are cavitated blades and furthermore have their own cooling system, for example blade emission. In these applications it is likewise important to ensure the best possible airtightness characteristic between the chamber 17 from which cooling air is taken and the main gas flow jet. This is what the seal 32 according to the invention allows. Furthermore, because of this seal 32, assembly becomes possible without the risks of interference between the turbine ring 5 and the turbine nozzle housing 11, and the ease of dismantling of the turbine modules is unaffected. Moreover, in operation, the flexibility of the seal 32 allows absorption of the dimensional differences which may appear between the turbine ring 5 and the turbine nozzle housing 11 and makes it possible to avoid introducing harmful interaction or mechanical stress on the parts.

Likewise, according to the second design of the invention, the cooling air from the external turbine chamber 17 enters the annular space 36 formed between the upstream 14*a* and downstream 14*b* parts of the downstream flange of the turbine nozzle housing 11. Then the air escapes through the passages 39 at the radially internal end, and these jets of air create a film on the leading edge 30 of the shroud 9 of the movable turbine blades 10. The other operating conditions are similar to those described for the initial design and similar advantageous results are likewise obtained.

What is claimed as new and is intended to be secured by Letters Patent is:

1. A cooling device for the peripheral shroud of movable blades of a turbine which includes a main flow through which gas circulates and including a rotor with a turbine ring forming a stationary part of said rotor, comprising:

a turbine nozzle located adjacent said movable blades and including a plurality of stationary turbine nozzle vanes;

an external chamber in communication with an air supply for providing cooling air to said stationary turbine nozzle vanes of said turbine nozzle and passing said air through a cavity portion formed adjacent said turbine nozzle vanes and to said turbine ring; and passage means in communication with said chamber for directing the air toward said peripheral shroud of the movable blades of the turbine rotor for ensuring cooling of said shroud from a leading edge portion thereof located on an upstream side thereof in relation to the direction of said gas circulation in the main flow wherein said passage means further comprises a plurality of cooling holes and means for calibrating said cooling holes so as to allow precise control of the rate of cooling air flowing to said shroud, said cooling holes further being circumferentially slanted for directing along an optimum angle jets of air on said leading edge of said shroud of the movable blades and for obtaining jets of air within a range of direction from parallel to the flow to slightly opposed to the flow without a centripetal radial component and wherein said leading edge portion of said shroud further comprises a raised profile downstream of said cooling holes, said profile being raised in relation to the extension of the shroud itself, thereby allowing a more efficient impingement cooling of said leading edge and a more efficient cooling of said shroud by an improved flow on an internal side of said shroud.

2. A cooling device for the peripheral shroud of movable blades of a turbine according to claim 1, further comprising:

a downstream turbine nozzle flange which further comprises a first and second flange part having an axial annular space formed therebetween wherein said passage means is in communication with said axial annular space and wherein said passage means further comprises a plurality of passages formed in an end portion of said first flange part of said flange; and a connecting angle bracket forming between said angle bracket and said flange a calibrated multihole distribution member through which said air passes so as to create a cooling film under the shroud of the turbine movable blades, said film being fed by a calibrated air flow.

3. A cooling device for the peripheral shroud of movable blades of a turbine according to claim 1, further comprising a support housing for said turbine nozzle and means for passing the cooling air from the external chamber to the cavity portion formed adjacent the turbine nozzle vanes and spool means mounted within said turbine nozzle in ball-and-socket fashion at each end thereof so as to absorb limited movement between the turbine nozzle and said support housing.

4. A cooling device for the peripheral shroud of movable blades of a turbine which includes a main jet through which gas circulates and including a rotor with a turbine ring forming a stationary part of said rotor, comprising:

a turbine nozzle located adjacent said movable blades and including a plurality of stationary turbine nozzle vanes;

an external chamber in communication with an air supply for providing cooling air to said stationary turbine nozzle vanes and passing said air through a cavity portion formed adjacent said turbine nozzle vanes and to said turbine ring;

passage means in communication with said chamber for directing the air toward said peripheral shroud of the movable blades of the turbine rotor for ensuring cooling of said shroud from a leading edge portion thereof located on an upstream side thereof in relation to the direction of said gas circulation in the main flow;

a downstream turbine nozzle flange which further comprises a first and second flange part having an axial annular space formed therebetween wherein said passage means is in communication with said axial annular space and wherein said passage means further comprises a plurality of passages formed in an end portion of said first flange part of said flange;

a connecting angle bracket forming between said angle bracket and said flange a calibrated multihole distribution member through which said air passes so as to create a cooling film under the shroud of the turbine movable blades, said film being fed by a calibrated air flow; and means for ensuring airtight connection between the external chamber which supplies said cooling air and the main jet wherein the means for ensuring airtight connection further comprises a flexible seal and wherein said flexible seal further comprises a plurality of elastic blades in sections of which a first tip portion thereof is attached to the first turbine nozzle flange and a second tip portion is supported on the turbine ring.

5. A cooling device for the peripheral shroud of movable blades of a turbine which includes a main jet through which gas circulates and including a rotor with a turbine ring forming a stationary part of said rotor, comprising:

a turbine nozzle located adjacent said movable blades and including a plurality of stationary turbine nozzle vanes;

an external chamber in communication with an air supply for providing cooling air to said stationary turbine nozzle vanes and passing said air through a cavity portion formed adjacent said turbine nozzle vanes and to said turbine ring;

passage means in communication with said chamber for directing the air toward said peripheral shroud of the movable blades of the turbine rotor for ensuring cooling of said shroud from a leading edge portion thereof located on an upstream side thereof in relation to the direction of said gas circulation in the main flow;

a downstream turbine nozzle flange which further comprises a first and second flange part having an axial annular space formed therebetween wherein said passage means is in communication with said axial annular space and wherein said passage means further comprises a plurality of passages formed in an end portion of said first flange part of said flange;

a connecting angle bracket forming between said angle bracket and said flange a calibrated multihole distribution member through which said air passes so as to create a cooling film under the shroud of the turbine movable blades, said film being fed by a calibrated air flow; and means for ensuring airtight connection between the external chamber which supplies said cooling air and the main jet wherein said platform further comprises an axial bearing, said turbine having a radial bearing portion and said seal further comprises an annular flange frontally supported on said radial bearing wherein said means for ensuring airtight connection further comprises a plurality of elastic clamps a first end portion of which is attached to a radially external part of said first turbine nozzle flange and a second end portion of which is connected to an annular flange frontally supported on said upstream radial bearing of the turbine ring so as to form a frontal airtight system and which is supported on said axial bearing of the platform of the turbine nozzle vane so as to form a radially airtight system.

* * * * *